US008465121B2

(12) United States Patent
Yamada et al.

(10) Patent No.: US 8,465,121 B2
(45) Date of Patent: Jun. 18, 2013

(54) FLUID EJECTING APPARATUS AND WIPING METHOD

(75) Inventors: Yoichi Yamada, Shiojiri (JP); Masaru Kobashi, Matsumoto (JP); Kiyoteru Katsuki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 203 days.

(21) Appl. No.: 13/023,476

(22) Filed: Feb. 8, 2011

(65) Prior Publication Data

US 2011/0193914 A1 Aug. 11, 2011

(30) Foreign Application Priority Data

Feb. 10, 2010 (JP) ..... 2010-028100

(51) Int. Cl.
*B41J 2/165* (2006.01)

(52) U.S. Cl.
USPC ..... 347/33

(58) Field of Classification Search
USPC ..... 347/22, 32–33
See application file for complete search history.

(56) References Cited

U.S. PATENT DOCUMENTS

| | | | | |
|---|---|---|---|---|
| 6,206,497 | B1 * | 3/2001 | Miura et al. | 347/28 |
| 7,762,656 | B2 * | 7/2010 | Snyder | 347/88 |
| 8,091,980 | B2 * | 1/2012 | Snyder et al. | 347/35 |
| 2001/0043251 | A1 | 11/2001 | Beachnau Hood et al. | |
| 2006/0268050 | A1 | 11/2006 | Sonobe | |
| 2008/0218554 | A1 | 9/2008 | Inoue | |

FOREIGN PATENT DOCUMENTS

| | | | |
|---|---|---|---|
| JP | 2001-063077 | A | 3/2001 |
| JP | 2008-221534 | A | 9/2008 |

* cited by examiner

*Primary Examiner* — Lamson Nguyen
(74) *Attorney, Agent, or Firm* — Kilpatrick Townsend & Stockton LLP

(57) ABSTRACT

A fluid ejecting apparatus includes: a fluid ejecting head in which nozzles that eject fluid are provided; a wiper that wipes a nozzle formation face, in which nozzle orifices of the nozzles are formed, in the fluid ejecting head; and a pressurization mechanism which changes the curvature of a concave liquid surface formed in the nozzle, in the nozzle by performing pressurization on the fluid in the fluid ejecting head at the time of the wiping.

6 Claims, 7 Drawing Sheets

FLUID EJECTING APPARATUS AND WIPING METHOD

BACKGROUND

1. Technical Field

The present invention relates to a fluid ejecting apparatus and a wiping method of the fluid ejecting apparatus.

2. Related Art

Heretofore, ink jet printers have been widely known as fluid ejecting apparatuses that eject fluid onto a medium. Such a printer is made so as to perform a printing process on paper (the medium) by ejecting ink (the fluid) from nozzles formed in a fluid ejecting head.

In such a printer, in order to stably eject ink droplets from the nozzles of the fluid ejecting head, the pressure in the fluid ejecting head, which is applied as a back pressure of a liquid in the nozzle, was normally set negative lower than the atmospheric pressure. In addition, such printers were sometimes provided with wipers for slidingly removing adherent materials (thickened ink, paper dust, and the like) formed on the nozzle formation face, on which the nozzle orifices are formed, of the fluid ejecting head (for example, JP-A-2001-063077 and JP-A-2008-221534).

In the printer disclosed in JP-A-2001-063077, a first surface of the wiper first comes into sliding contact with the nozzle formation face, thereby drawing out ink from inside the nozzle, and the adherent materials dissolved in the drawn-out ink are then scraped away by a second surface of the wiper that comes into sliding contact with the nozzle formation face after the first surface.

In the case of the printer disclosed in JP-A-2008-221534, by exuding ink in the nozzle to the nozzle formation face by pressurization and then by wiping, the adherent materials, which are dissolved in ink, are removed.

Incidentally, as with JP-A-2001-063077, when ink has been drawn out from inside the nozzle at the time of wiping, ink is supplied from the upstream side of the nozzle by capillary action. However, since the pressure at the back side of a liquid in the nozzle is normally set to be negative pressure, the ink is not sufficiently supplied to the nozzle when wiping is performed at high speed. As a result, air bubbles are mixed in the nozzle or the position of the liquid surface greatly retreats. This causes dot omission.

On the other hand, as with the printer disclosed in JP-A-2008-221534, if the back pressure of a liquid in the nozzle is set to be positive pressure, dot omission can be suppressed even when ink is drawn out from the inside of the nozzle as ink is supplied promptly. However, if the wiper comes into contact with the liquid surface exuded to the nozzle formation face, since the back pressure is positive pressure, there is a problem in which ink is wasted by continuously flowing out down the wiper.

SUMMARY

An advantage of some aspects of the invention is that it provides a fluid ejecting apparatus and a wiping method, which allow the occurrence of dot omission to be suppressed while suppressing consumption of fluid involved in wiping.

According to a first aspect of the invention, there is provided a fluid ejecting apparatus including: a fluid ejecting head in which nozzles that eject fluid are provided; a wiper which wipes a nozzle formation face, on which the nozzle orifices of the nozzles are formed, of the fluid ejecting head; and a pressurization mechanism which changes curvature of a concave liquid surface formed in the nozzles, in the nozzle by performing pressurization on the fluid in the fluid ejecting head at the time of the wiping.

According to this configuration, since at the time of wiping, the pressurization mechanism applies pressure to the fluid in the fluid ejecting head, in a case where the wiper has drawn out the fluid from the inside of the nozzle, the fluid is promptly supplied into the nozzle. By doing so, occurrence of dot omission can be suppressed. Also, changes in pressure by the pressurization mechanism are applied in a minute range of an extent that changes the curvature of the liquid surface in the nozzle without moving the position of the boundary of the liquid surface. For this reason, since contact between the wiper and the liquid surface is only for a short time while the wiper enters into and passes through the nozzle, continuous outflow of fluid is not caused. Therefore, it is possible to suppress the occurrence of dot omission while suppressing the consumption of fluid involved in wiping.

In the fluid ejecting apparatus according to the above aspect of the invention, the pressurization mechanism may apply pressure in such a manner that the position of the boundary of the liquid surface is fixed while the pressure is applied, and also in which the central area of the liquid surface does not spill out from the nozzle orifices.

According to this configuration, since the pressurization mechanism applies pressure in such a manner that the position of the boundary of the liquid surface is fixed while the pressure is applied, and also in which the central area the liquid surface does not spill out from the nozzle orifices, excessive contact between the liquid surface and the wiper due to the protruding of the liquid surface from the nozzle orifices can be suppressed.

In the fluid ejecting apparatus according to the above aspect of the invention, a water repellent treatment may be carried out in the vicinity of the nozzle orifice of a nozzle and the pressurization mechanism may apply the pressure such that the pressure of the fluid in the fluid ejecting head, which is applied as a back pressure of the liquid, becomes equal to or greater than the pressure of the gas that comes into contact with the liquid surface.

According to this configuration, since the water repellent treatment is carried out in the vicinity of the nozzle orifice, the liquid surface retreats further inward than the water repellent treatment portion in which the water repellent is carried out. Therefore, even if the pressure of the fluid in the fluid ejecting head, which becomes the back pressure of the liquid, is set to be equal to or greater than the pressure of the gas that comes into contact with the liquid surface, so that a convex liquid surface is formed in the nozzle, excessive contact of the liquid surface with the wiper due to the protruding of the liquid surface from the nozzle orifices can be suppressed. Also, the occurrence of dot omission can be further suppressed by making the back pressure of the liquid positive pressure in this manner.

In the fluid ejecting apparatus according to the above aspect of the invention, the concave liquid surface may be formed in the nozzle such that the boundary of the liquid surface comes into contact with the nozzle orifice and also the central area of the liquid surface is drawn into the nozzle.

According to this configuration, since the concave liquid surface is formed in the nozzle such that the boundary of the liquid surface comes into contact with the nozzle orifice and also the central area of the liquid surface is drawn into the nozzle, the liquid surface does not protrude from the nozzle orifice.

The fluid ejecting apparatus according to the above aspect of the invention may include a decompression mechanism that decompresses the fluid in the fluid ejecting head, wherein the pressurization mechanism applies pressure so that the curvature of the liquid surface becomes smaller than that at the time of the decompression.

According to this configuration, since the pressurization mechanism applies pressure so that the curvature of the liquid surface becomes smaller than that at the time of decompression, it is possible to bring the pressure of the fluid in the fluid ejecting head at the time of wiping close to the pressure of the gas that comes into contact with the liquid surface. As a result, it is possible to suppress the occurrence of dot omission while suppressing the consumption of fluid involved in wiping.

According to a second aspect of the invention, there is provided a wiping method which wipes a nozzle formation face in which nozzle orifices of nozzles are formed, the nozzles being provided in a fluid ejecting head and ejecting fluid, the method including: a wiping process which wipes the nozzle formation face in a state where curvature of a concave liquid surface formed in the nozzle is changed in the nozzle by pressurizing the fluid in the fluid ejecting head.

According to this configuration, since the fluid in the fluid ejecting head is pressurized during the wiping, in a case where the wiper has drawn out fluid from the inside of the nozzle, the fluid is promptly supplied into the nozzle. By doing so, dot omission can be suppressed. Also, changes in the pressure by pressurization are applied in a minute range of an extent that changes the curvature of the liquid surface in the nozzle without moving the position of the boundary of the liquid surface that comes into contact with the nozzle. For this reason, since the contact between the wiper and the liquid surface is only for a short time while the wiper enters into and passes through the nozzle, continuous outflow of the fluid is avoided. Therefore, it is possible to suppress the occurrence of dot omission while suppressing the consumption of the fluid involved in wiping.

BRIEF DESCRIPTION OF THE DRAWINGS

The invention will be described with reference to the accompanying drawings, wherein like numbers reference like elements.

FIGS. 4A and 4B are cross-sectional views for explaining the configuration and the action of a differential pressure valve, wherein FIG. 4A shows the position of the valve when closing and FIG. 4B shows the position of valve when opening.

FIGS. 5A and 5B are schematic views showing a liquid surface position in a nozzle in the first embodiment, wherein FIG. 5A shows a state at the time of decompression and FIG. 5B shows a state at the time of pressurization.

FIGS. 7A and 7B are schematic views showing a liquid surface position in the nozzle in the second embodiment, wherein FIG. 7A shows a state at the time of decompression and FIG. 7B shows a state at the time of pressurization.

DESCRIPTION OF EXEMPLARY EMBODIMENTS

First Embodiment

Hereinafter, the first embodiment that embodies the invention in an ink jet printer (hereinafter simply referred to as a "printer") which is one type of a fluid ejecting apparatus will be described with reference to FIGS. 1 to 6. In addition, a "front-and-back direction", a "right-and-left direction", and an "up-and-down direction", as mentioned in the following explanation, are respectively set to represent a front-and-back direction, a right-and-left direction, and an up-and-down direction, that are indicated by arrows in each drawing.

Figure 1:
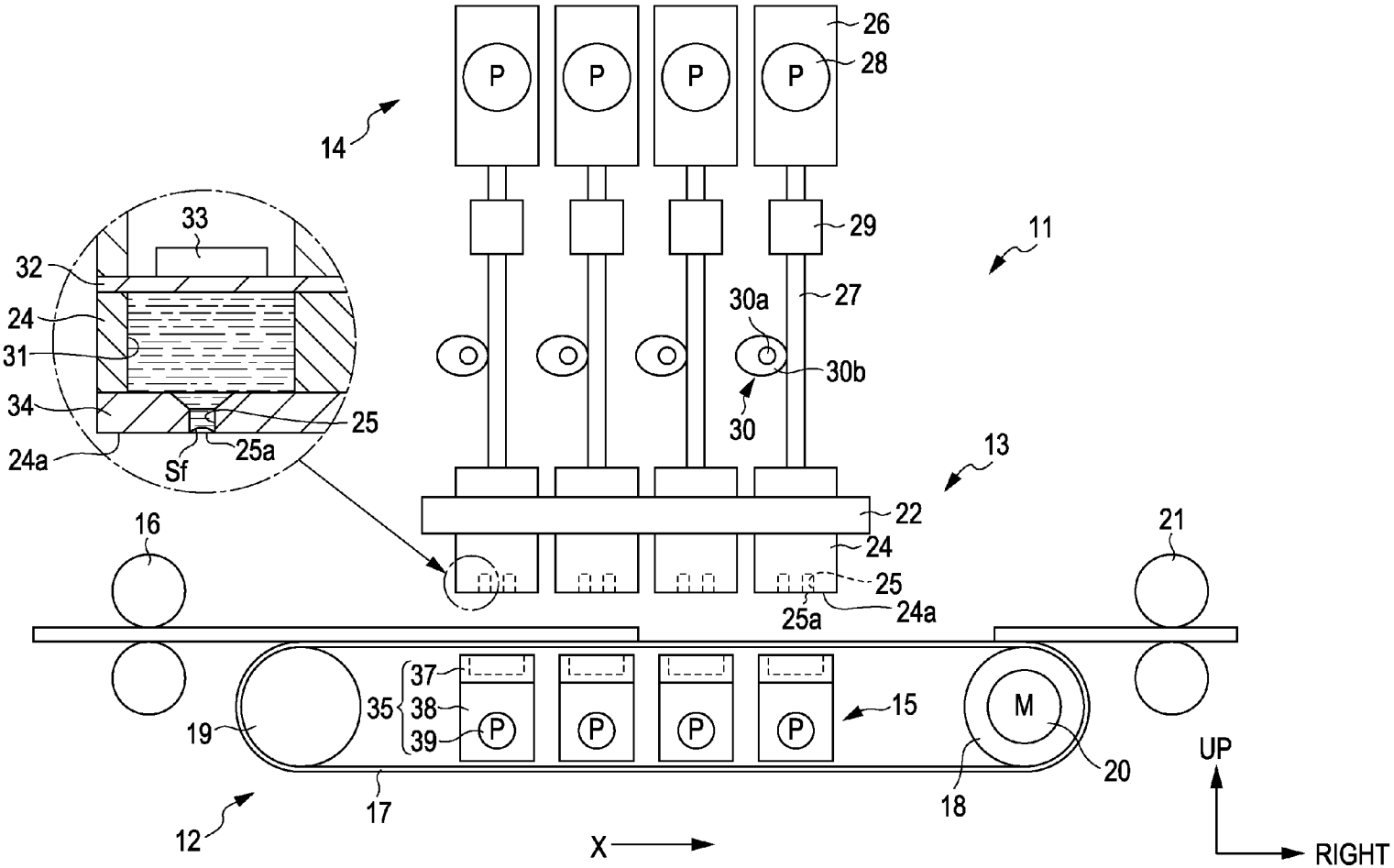
FIG. 1 is a schematic view showing a schematic configuration of an ink jet printer in the first embodiment.

As shown in FIG. 1, a printer 11 includes a transport mechanism 12 which transports paper P as a medium, a line head 13 that performs printing process on the paper P, an ink supply unit 14 which supplies ink as fluid to the line head 13, and a maintenance unit 15.

The transport mechanism 12 includes a pair of paper feed rollers 16, an endless transport belt 17, a driving roller 18, a driven roller 19, a driving motor 20 connected to the driving roller 18, and a pair of paper discharge rollers 21. The transport belt 17 is wound around the driving roller 18 and the driven roller 19 and revolves if the driving roller 18 is rotated in the clockwise direction in FIG. 1 by driving of the driving motor 20. Then, the paper P is transported along a transport direction X by the paper feed rollers 16, the transport belt 17, and the paper discharge rollers 21. In addition, the transport belt 17 is provided in a plurality (for example, two) so as to support at least both ends in the width direction (the front-and-back direction) of the paper P, while the maintenance unit 15 is also disposed between the transport belts 17 that line up in the front-and-back direction.

The line head 13 includes a support portion 22 and a fluid ejecting head 24 supported on the support portion 22. A plurality of nozzles 25 for ejecting ink is provided at the fluid ejecting head 24. Then, nozzle orifices 25*a* of the plurality of nozzles 25 are formed in a nozzle formation face 24*a* which is composed of a lower face (bottom face) of the fluid ejecting head 24.

In addition, for example, in a case where color printing in four colors, cyan (C), magenta (M), yellow (Y), and black (K), is performed, the line head 13 and the ink supply unit 14 are provided in four sets for each color. Then, a printing process is carried out by overlapping and causing ink droplets of four colors from four line heads 13 supported on the support portion 22, to strike onto the transported paper P.

The ink supply unit 14 includes an ink cartridge 26 that contains ink, an elastically deformable ink supply tube 27 constituting a fluid supply path which supplies ink from the ink cartridge 26 toward the fluid ejecting head 24 side, and a pressurizing pump 28 for pressurizing and supplying ink. In addition, the ink cartridge 26 is detachably mounted on a cartridge holder (not shown), thereby being connected to the ink supply tube 27. Also, a differential pressure valve 29, which also functions as a decompression mechanism, and a pressurization mechanism 30 are provided at points along the ink supply tube 27.

As shown in an enlarged cross-sectional view of a portion surrounded by a double-dot chain line in FIG. 1, a cavity 31 which communicates at the upstream side thereof with the ink supply tube 27 through an ink flow path (not shown) and at the downstream side with the nozzle 25 is formed in the fluid ejecting head 24. A wall surface on the upper side of the cavity 31 is constituted by a vibration plate 32, and a piezoelectric element 33 is placed at a position above the cavity 31 on the upper surface side of the vibration plate 32. Also, the nozzle 25 is formed to penetrate a nozzle plate 34 which constitutes a lower surface of the fluid ejecting head 24.

The vibration plate 32 is mounted so as to be able to vibrate in the up-and-down direction, and the piezoelectric element 33 is made so as to extend and contract in response to a driving signal, thereby vibrating the vibration plate 32 in the up-and-down direction. Also, if the vibration plate 32 vibrates in the up-and-down direction, the volume of the cavity 31 is expanded and reduced. Then, if the volume of the cavity 31 is reduced, ink supplied into the cavity 31 through the ink supply tube 27 is ejected as an ink droplet from the nozzle 25.

In addition, the nozzle 25 is formed so as to have a high affinity (in wettability) with ink. For this reason, a concave liquid surface Sf (meniscus) is formed in the nozzle 25. Here, the meniscus means a curved fluid surface that is generated by the relative size relations of an adhesion force acting between the molecules of fluid (ink) and a solid surface (the nozzle 25 or the nozzle formation face 24*a*), and a cohesion force between the fluid molecules when the fluid comes into contact with the solid surface.

Next, an explanation will be made on the maintenance unit 15.

Figure 2:
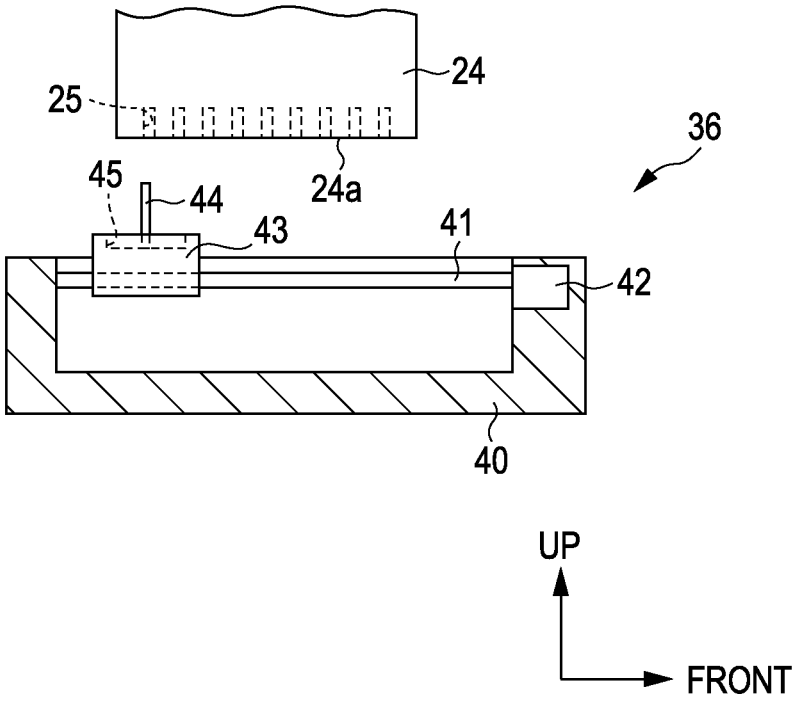
FIG. 2 is a cross-sectional view showing a schematic configuration of a wiping device.
Figure 3:
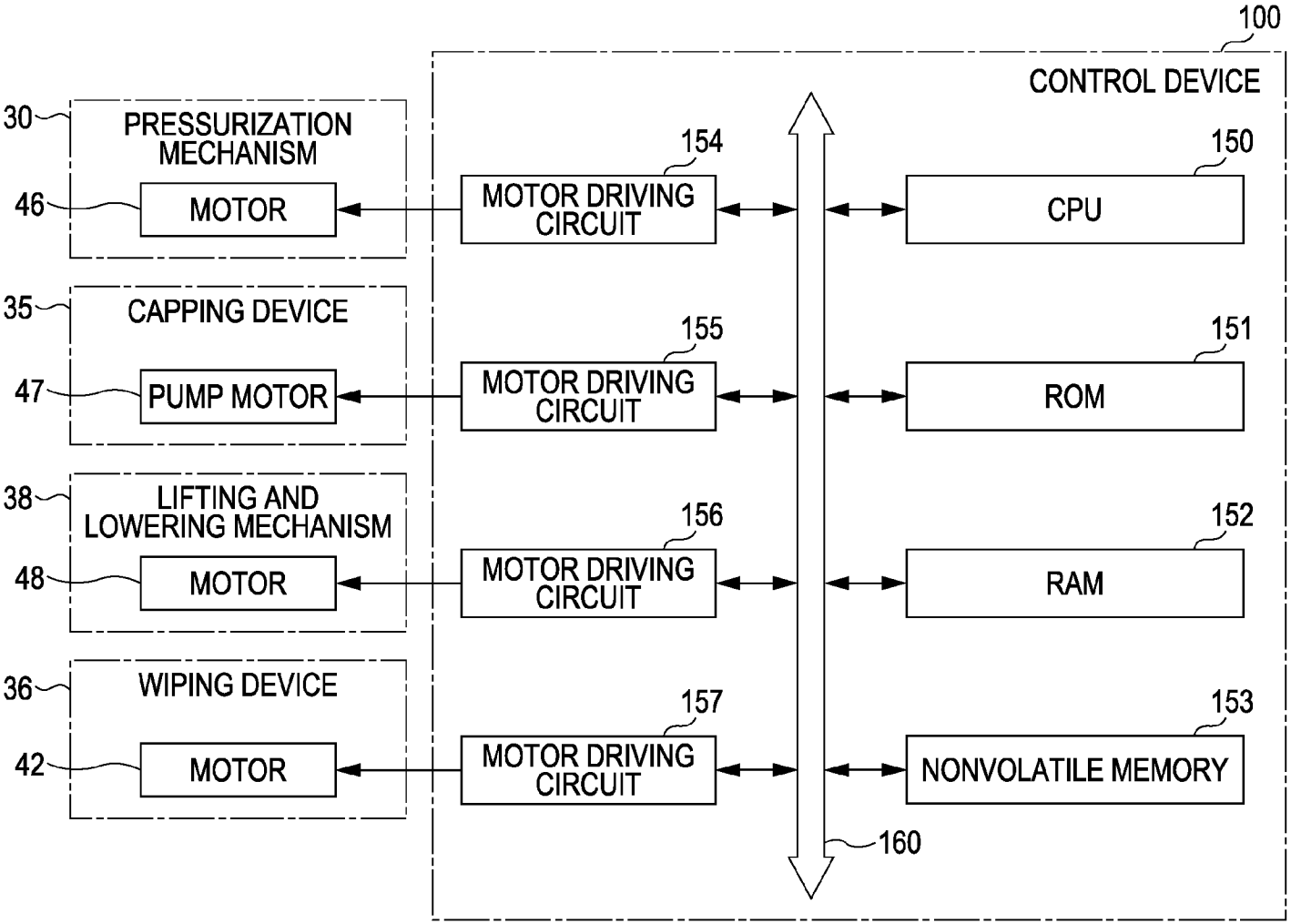
FIG. 3 is a block diagram showing the electrical configuration of a control device.

The maintenance unit 15 includes the pressurization mechanism 30, a capping device 35 for capping the nozzle formation face 24*a* of the fluid ejecting head 24, a wiping device 36 (refer to FIG. 2) for wiping the nozzle formation face 24*a*, and a control device 100 (refer to FIG. 3). The pressurization mechanism 30, the capping device 35, and the wiping device 36 are respectively provided for each fluid ejecting head 24.

The pressurization mechanism 30 includes a turning shaft 30*a* and a cam member 30*b* that turns along with the turning shaft 30*a*. The pressurization mechanism 30 is made such that the cam member 30*b* crushes the ink supply tube 27 with the turning in a forward direction of the turning shaft 30*a*, thereby pressurizing ink in the ink supply tube 27 and the fluid ejecting head 24. Also, if the cam member 30*b* of the pressurization mechanism 30 turns in a reverse direction, thereby returning to the original position, the pressure is released.

The capping device 35 is used for the capping for preventing drying of the nozzle 25 and for carrying out suction cleaning which discharges air bubbles, thickened ink, or the like by sucking ink in the ink cartridge 26 from the nozzle 25. Further, the capping device 35 is used for containing ink, which is discharged from the nozzle 25, also at the time of pressurization cleaning that discharges ink in the ink cartridge 26 from the nozzle 25 using the pressurizing pump 28.

As shown in FIG. 1, the capping device 35 includes a bottomed square box-shaped cap 37, a lifting and lowering mechanism 38 which moves the cap 37 up and down, and a suction pump 39. Then, if the suction pump 39 is driven in a state where the cap 37 moved upward by the lifting and lowering mechanism 38 comes into contact with the nozzle formation face 24*a*, the suction cleaning in which ink is discharged from the nozzle 25 is carried out.

The wiping device 36 is used when carrying out wiping for removing adherent materials such as paper dust or ink by wiping the nozzle formation face 24*a*.

As shown in FIG. 2, the wiping device 36 includes a holder 40, a lead screw 41 mounted on the holder 40 so as to extend along the front-and-back direction, a motor 42 for rotating the lead screw 41, a support member 43, and a plate-shaped wiper 44 which is composed of an elastic body such as rubber. The wiper 44 is supported in a state where it is provided in an erect manner on the support member 43, and also the support member 43 is supported on the lead screw 41. Also, a concave storage portion 45 is formed at the upper surface side of the support member 43.

The wiping device 36 is made such that the wiper 44 can move upward up to a position where the wiper comes into contact with the nozzle formation face 24*a* due to the lifting and lowering mechanism 38. If the motor 42 is driven in a state where the wiper 44 has come into contact with the nozzle formation face 24*a*, the lead screw 41 is rotated, so that the wiper 44 comes into sliding contact with the nozzle formation face 24*a* in the process of moving along the front-and-back direction together with the support member 43. As a result, wiping is carried out to clean the nozzle formation face 24*a* by sweeping. At this time, ink or paper dust wiped away from the nozzle formation face 24*a* falls down the wiper 44 and is then stored in the concave storage portion 45.

Next, an explanation will be made on the electrical configurations of the control device 100 and the maintenance unit 15.

As shown in FIG. 3, the control device 100 includes a CPU 150 functioning as a selection section, a ROM 151, a RAM 152, and a nonvolatile memory 153. A control program which is executed by the CPU 150, or the like is stored in the ROM 151. Also, results of the operations of the CPU 150, various data that execute and process the control program, or the like are temporarily stored in the RAM 152. Also, operation history of the printer 11, or the like is stored in the rewritable nonvolatile memory 153.

Also, the control device 100 further includes motor driving circuits 154 to 157, and these motor driving circuits are mutually connected to the CPU 150, the ROM 151, the RAM 152, and the nonvolatile memory 153 through a bus 160. Then, the CPU 150 performs driving control of the maintenance unit 15. In addition, the control device 100 may double as a control device that controls the entire operation of the printer 11.

Specifically, the CPU 150 controls the driving of a motor 46 for turning the turning shaft 30*a* of the pressurization mechanism 30 through the motor driving circuit 154. Also, the CPU 150 controls the driving of a pump motor 47 for driving the suction pump 39 of the capping device 35 through the motor driving circuit 155 and also controls the driving of a motor 48 of the lifting and lowering mechanism 38 for lifting and lowering the cap 37 and the wiper 44 through the motor driving circuit 156. Also, the CPU 150 controls the driving of the motor 42 for moving the wiper 44 of the wiping device 36 in the front-and-back direction through the motor driving circuit 157.

Next, the differential pressure valve 29 will be described. The differential pressure valve 29 is a diaphragm type self-sealing valve, which performs opening and closing by using differential pressure between the atmospheric pressure and the pressure of ink, and is disposed between the ink cartridge 26 and the pressurization mechanism 30.

Figure 4A:
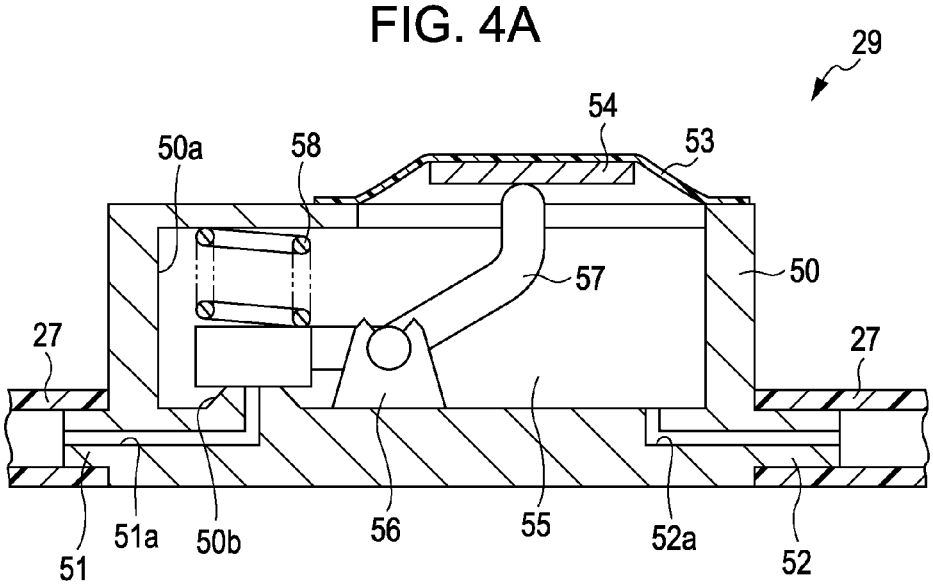

As shown in FIG. 4A, the differential pressure valve 29 has a flow path that forms a member 50 having a fixed-shape property. A connection portion 51 which is connected to the upstream-side ink supply tube 27 that communicates with the ink cartridge 26 is provided at one end (the left end in FIGS. 4A and 4B) of the flow path to form the member 50. On the other hand, a connection portion 52 that is connected to the downstream-side ink supply tube 27 which communicates with the fluid ejecting head 24 is provided at the right end of the flow path to form the member 50. Also, a concave portion 50*a* having a circular shape in a plan view is formed at one face side (the upper face side in FIGS. 4A and 4B) of the flow path to form the member 50 and also one convex portion 50*b* having a circular truncated cone shape is formed at a position deviated from the center to the left on the inner bottom surface of the concave portion 50*a*. Then, an inflow path 51*a* that makes the upstream-side ink supply tube 27 communicate with the inside of the concave portion 50*a* is formed in the connection portion 51 in such a manner that an opening to the inside of the concave portion 50*a* is formed in the upper end surface of the convex portion 50*b*. On the other hand, an outflow path 52*a* that makes the downstream-side ink supply tube 27 communicate with the inside of the concave portion 50*a* is formed in the connection portion 52.

A film member 53 having flexibility is fixed to the upper face side of the flow path forming member 50 so as to seal an opening of the concave portion 50*a* in a state where the film member has curvature. Also, a circular disc-shaped pressing plate 54 having an area smaller than the area of the opening of the concave portion 50*a* is fixed to an approximately central portion on the inner face side of the film member 53 that faces the inside of the concave portion 50*a*. Then, a pressure chamber 55 is surrounded and formed by the film member 53 and the concave portion 50*a*.

A base portion 56, an arm member 57 supported on the base portion 56 so as to be able to tilt, and a biasing spring 58 which biases one end side (the left end side) of the arm member 57 toward the convex portion 50*b* side are housed in the pressure chamber 55. The arm member 57 normally receives the biasing force of the biasing spring 58, thereby being in a state where one end side thereof seals an opening of the inflow path 51*a*, which is provided in the upper end face of the convex portion 50*b*, while the other end side (the right end side) pushes the pressing plate 54 upward.

As a result, the film member 53 is bent and displaced in a direction expanding the inner volume of the pressure chamber 55, whereby the pressure chamber 55 and the inside of the fluid ejecting head 24 which is located at a downstream zone of the pressure chamber are under negative pressure. Also, ink is supplied to the inflow path 51*a* in a pressurized state by the pressurizing pump 28 and a state is always created in which the inflow to the inside of the pressure chamber 55 is suppressed by one end side of the arm member 57 receiving the biasing force of the biasing spring 58.

Figure 4B:
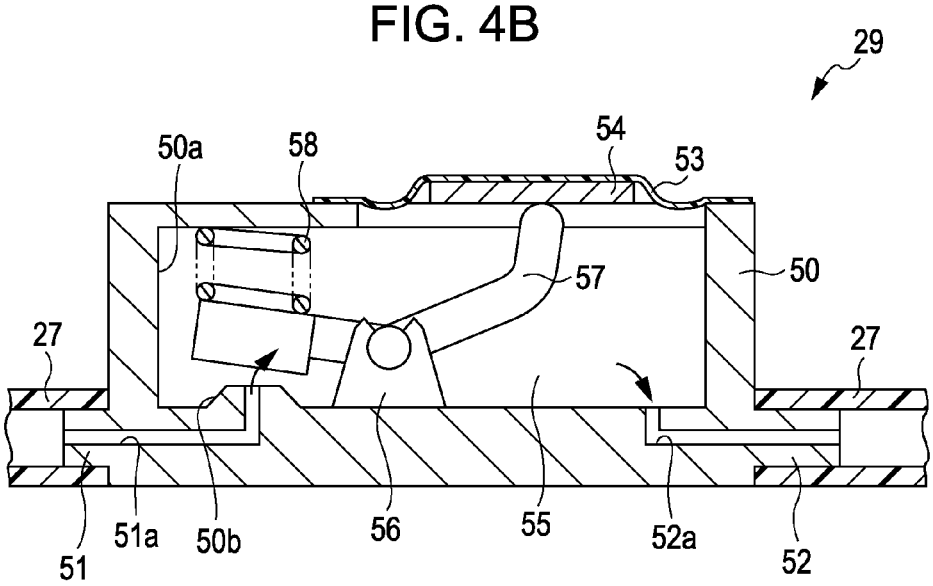

Then, if ink is consumed due to ejection or outflow from the nozzle 25, the negative pressure in the pressure chamber 55 increases, whereby the film member 53 is bent and displaced in a direction reducing the inner volume of the pressure chamber 55 against the biasing force of the biasing spring 58, as shown in FIG. 4B. Then, the other end side of the arm member 57 is tilted by being pressed by the film member 53 through the pressing plate 54, whereby one end side opens the opening of the inflow path 51*a*, so that the pressurized ink flows into the pressure chamber 55 through the inflow path 51*a*.

Then, if the negative pressure in the pressure chamber 55 is reduced with the inflow of ink, the arm member 57 and the film member 53 return again to the original positions due to the biasing force of the biasing spring 58. Therefore, ink is supplied to the fluid ejecting head 24 in accordance with the amount of consumption.

In this manner, when the differential pressure valve 29 is in a closing state which becomes a steady state, the pressure chamber 55 and the inside of the fluid ejecting head 24, which is located at the downstream side of the pressure chamber, are under negative pressure. In the printer 11, in order to prevent ink falling due to gravity and also to stabilize an ejection operation, the pressure of ink in the fluid ejecting head 24 (hereinafter, the pressure is referred to as "back pressure") is kept at negative pressure in the order of −1 kPa by the differential pressure valve 29.

Figures 5A, 5B:
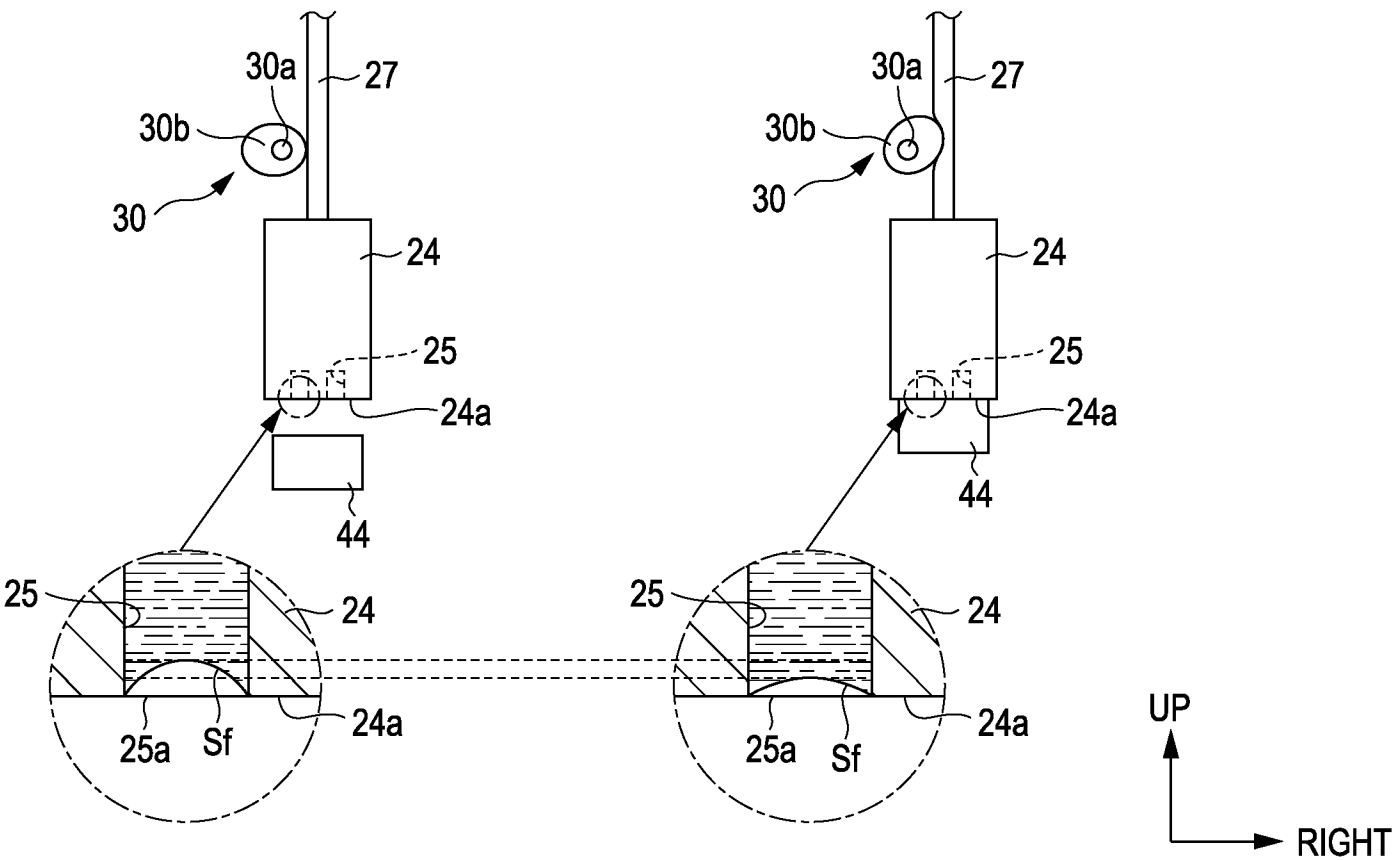

That is, in this embodiment, a state where the ink in the fluid ejecting head 24 is decompressed in preparation for an ink ejecting operation, whereby the concave liquid surface Sf is formed in the nozzle 25 as shown in FIG. 5A, is regarded as a steady state. In addition, in the partially enlarged view of FIG. 5A, a liquid surface position in a case where the inside of the fluid ejecting head 24 is decompressed to about −1 kPa by the differential pressure valve 29 (hereinafter, this case is referred to as "the time of decompression") is shown.

In the steady state, the liquid surface Sf is formed in the nozzle 25 such that the boundary of the liquid surface Sf comes onto contact with the nozzle orifice 25*a*, and also the central area of the liquid surface Sf is drawn into the inside of the nozzle 25. Then, the boundary of the liquid surface Sf is clipped to the nozzle orifice 25*a*, whereby, even if the back pressure changes within a predetermined range, the position of the boundary of the liquid surface Sf does not change and only curvature changes. In addition, "being clipped" means a state where the liquid surface Sf is caught on a portion, in which a shape, a surface state, or the like changes, whereby it becomes more difficult for a liquid surface position to move than at a flat portion. Also, in the steady state, the curvature of the liquid surface Sf formed in the nozzle 25 becomes larger than that in a case where the back pressure is equal to the pressure (in this embodiment, the atmospheric pressure) of gas that comes into contact with the liquid surface Sf. In addition, the back pressure is expressed as differential pressure (gauge pressure) with respect to the pressure of gas which comes into contact with the liquid surface Sf.

Next, an explanation will be made regarding wiping in this embodiment.

At the time of wiping, in order to scrape away the adherent materials, the wiper 44 slides in contact with the nozzle formation face 24*a* in a state where the leading end thereof is elastically deformed. For this reason, when the wiper 44 passes through the nozzle orifice 25*a*, the wiper 44 sometimes enters into the nozzle 25, thereby coming into contact with the liquid surface Sf of the ink. At this time, if an adhesion force (wettability) that acts between the wiper 44 and ink is large, the ink in the nozzle 25 is drawn out by the wiper 44. In addition, in a case where the wiper 44 is constituted by a material having a high affinity with ink or a material which has a rough surface roughness or a case where the scraped-away thickened ink, paper dust, or the like is attached to the wiper 44, the adhesion force which acts between the wiper and ink is increased.

If ink is drawn out from the inside of the nozzle 25 at the time of wiping, ink is supplied from the cavity 31 on the upstream side of the nozzle 25 by capillary action. However, since the back pressure of ink is normally kept at negative pressure, particularly in a case where wiping is performed at high speed, the supply of ink is too slow so that air bubbles are sometimes mixed in the nozzle 25 or the liquid surface position sometimes greatly retreats inward. Such mixing-in of air bubbles or retreat of a liquid surface position becomes a factor causing dot omission when performing a printing process.

Since the dot omission involved in wiping is caused due to the supply of ink by capillary action being not in time for the outflow of ink, it can be said that dot omission is more easily generated when back pressure is lower, while it is less easily generated when the back pressure is higher. However, if the wiper 44 comes into contact with the liquid surface Sf in a state where the back pressure is positive pressure, the ink sometimes exudes continuously, thereby being wasted. For this reason, in order to suppress both the dot omission and the ink consumption, it is preferable to make the back pressure equal to the atmospheric pressure at the time of wiping.

Therefore, in the printer 11, while the inside of the fluid ejecting head 24 is decompressed by the differential pressure valve 29 when it is paused or when the printing process that ejects ink, at the time of wiping, pressure is applied on the decompressed ink in the fluid ejecting head 24 by the pressurization mechanism 30, thereby changing, in the nozzle 25, the curvature of the concave liquid surface Sf formed in the nozzle 25.

In addition, in the following explanation, while the above-described steady state of the fluid ejecting head 24 is referred to as "the time of decompression", a state where pressure is applied to the decompressed ink in the fluid ejecting head 24 by the pressurization mechanism 30 is referred to as "the time of pressurization". Then, at the time of pressurization, in order to bring the back pressure close to the atmospheric pressure and also suppress excessive contact between the wiper 44 and the liquid surface Sf, pressure is applied in a range in which the position of the boundary of the liquid surface Sf is fixed during pressurization and in which the central area of the liquid surface Sf is not swollen from the nozzle orifice 25*a*.

In addition, since the liquid surface Sf has a concave shape due to capillary action and the wettability of the nozzle 25 in a case where the back pressure is equal to the atmospheric pressure, when the back pressure becomes positive pressure slightly larger than the atmospheric pressure, the liquid surface Sf has a planar shape of zero curvature. Therefore, in a case where the back pressure at the time of pressurization is larger than the back pressure at the time of decompression and a pressurizing force is adjusted so as to be equal to or less than the atmospheric pressure, although the liquid surface Sf at the time of pressurization is a concave shape like that at the time of decompression, the curvature thereof becomes smaller than that at the time of decompression. In addition, even if the back pressure at the time of pressurization is higher than the atmospheric pressure, since it is acceptable if the liquid surface Sf becomes a convex shape, thereby not being swollen from the nozzle orifice 25*a*, the liquid surface Sf at the time of pressurization may be a concave shape having a curvature smaller than that at the time of decompression or may be a planar shape.

Next, the wiping execution process by the CPU 150 will be described with reference to FIG. 6.

Figure 6:
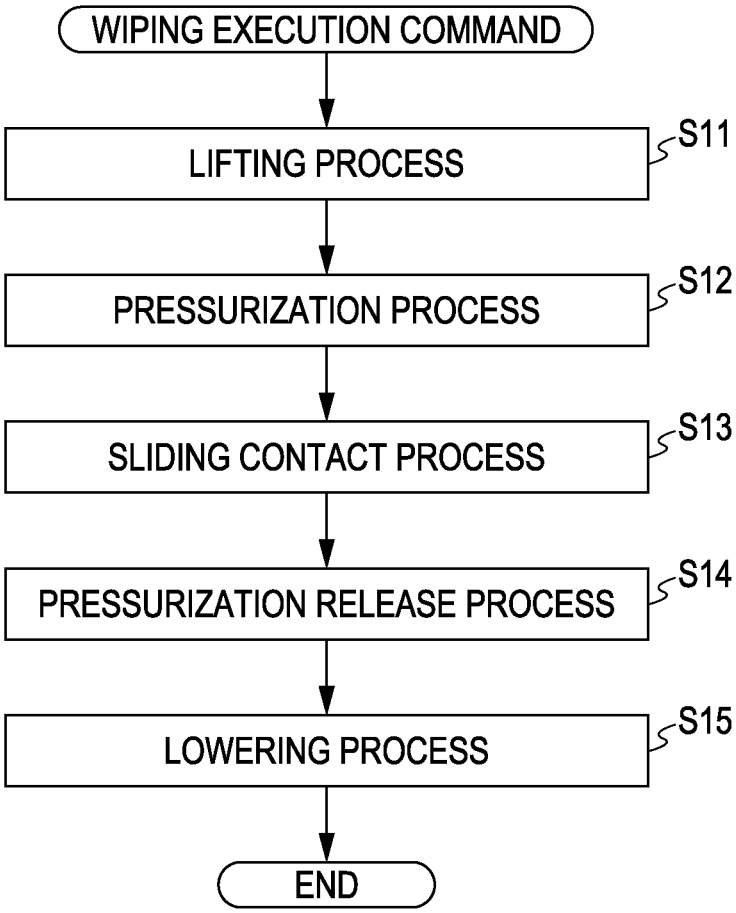
FIG. 6 is a flowchart showing the wiping process.

As shown in FIG. 6, if the control device 100 receives a wiping execution command, as a lifting process of a step S11, the CPU 150 performs control so as to drive the motor 48 of the lifting and lowering mechanism 38 in a forward direction, thereby lifting the wiper 44 up to a position where the wiper comes into contact with the nozzle formation face 24*a*. Next, as a pressurization process of a step S12, the CPU 150 performs control so as to drive the motor 46 of the pressurization mechanism 30 in a forward direction, thereby turning the cam member 30*b* in a forward direction (clockwise in FIGS. 5A and 5B). As a result, the ink in the fluid ejecting head 24 is pressurized, so that the curvature of the liquid surface Sf in the nozzle 25 becomes smaller than that at the time of decompression, as shown in FIG. 5B. At this time, the drive amount of the motor 46 is adjusted such that the position of the boundary of the liquid surface Sf is kept and also the central vicinity of the liquid surface Sf is not swollen from the nozzle orifice 25*a*.

Next, as a sliding contact process (a wiping process) of a step S13, the CPU 150 controls the driving of the motor 42 of the wiping device 36, thereby moving the wiper 44 in the front-and-back direction (a direction perpendicular to a plane of paper in FIGS. 5A and 5B). As a result, wiping of the nozzle formation face 24*a* is performed in a state where the curvature of the concave liquid surface Sf formed in the nozzle 25 has been changed in the nozzle 25 by pressurizing ink in the fluid ejecting head 24.

Then, in the process in which the wiper 44 slides in contact with the nozzle formation face 24*a*, the nozzle formation face 24*a* is wiped away while wetting the nozzle formation face 24*a* with ink drawn out from the nozzle 25, thereby dissolving the adherent materials in the ink. Then, since the back pressure is set to be higher than that at the time of decompression when the wiper 44 comes into contact with the liquid surface Sf, even in a case where the wiper 44 moves in the front-and-back direction at a fast speed, ink is promptly supplied into the nozzle 25 with the drawing-out of ink by the wiper 44.

Next, as a pressurization release process of a step S14, the motor 46 of the pressurization mechanism 30 is controlled so as to be driven in a reverse direction, thereby turning the cam member 30*b* in the opposite direction (the counterclockwise direction in FIGS. 5A and 5B) to that in the pressurization process. In addition, in a case where the turning shaft 30*a* is turned 180 degrees in the pressurization process, in the pressurization release process, the turning shaft 30*a* may be turned 180 degrees in the same direction as that in the pressurization process. As a result, the pressurization is released, whereby the back pressure returns to negative pressure in the order of −1 kPa.

Finally, as a lowering process of a step S15, the CPU 150 performs control so as to drive the motor 48 of the lifting and lowering mechanism 38 in a reverse direction, thereby lowering the wiper 44 down to the original position to finish the process.

According to the embodiment described above, the following effects can be obtained.

(1) Since at the time of wiping, the pressurization mechanism 30 performs pressurization on ink in the fluid ejecting head 24, when the wiper 44 has drawn out ink from the inside of the nozzle 25, ink is promptly supplied into the nozzle 25. As a result, even in a case where wiping is performed at high speed, the occurrence of dot omission can be suppressed. Also, a pressure change of the back pressure by the pressurization mechanism 30 is performed in a minute range of an extent that changes the curvature of the liquid surface Sf in the nozzle 25 without moving the position of the boundary of the liquid surface Sf. For this reason, since the contact between the wiper 44 and the liquid surface Sf is only for a short time while the wiper 44 enters into and passes through the nozzle 25, continuous outflow of ink is avoided. Therefore, it is possible to suppress the occurrence of dot omission while also suppressing the consumption of ink involved in wiping.

(2) Since the pressurization mechanism 30 performs pressurization in a range in which the liquid surface Sf is not swollen from the nozzle orifice 25*a*, it is possible to suppress excessive contact between the liquid surface Sf and the wiper 44 due to the protrusion of the liquid surface Sf from the nozzle orifice 25*a*.

(3) Since the concave liquid surface Sf is formed in the nozzle 25 such that the boundary of the liquid surface Sf comes into contact with the nozzle orifice 25*a* and also the central area of the liquid surface Sf is drawn into the nozzle 25, the liquid surface Sf does not protrude from the nozzle orifice 25*a*.

(4) Since the pressurization mechanism 30 performs pressurization such that the curvature of the liquid surface Sf becomes smaller than that at the time of decompression, it is possible to bring the back pressure (the pressure of ink in the fluid ejecting head 24) at the time of wiping close to the atmospheric pressure (the pressure of the gas that comes into contact with the liquid surface Sf). As a result, it is possible to suppress the occurrence of dot omission while suppressing the consumption of ink involved in wiping.

Second Embodiment

Next, the second embodiment of the invention will be described based on FIGS. 7A and 7B.

Figure 7B:
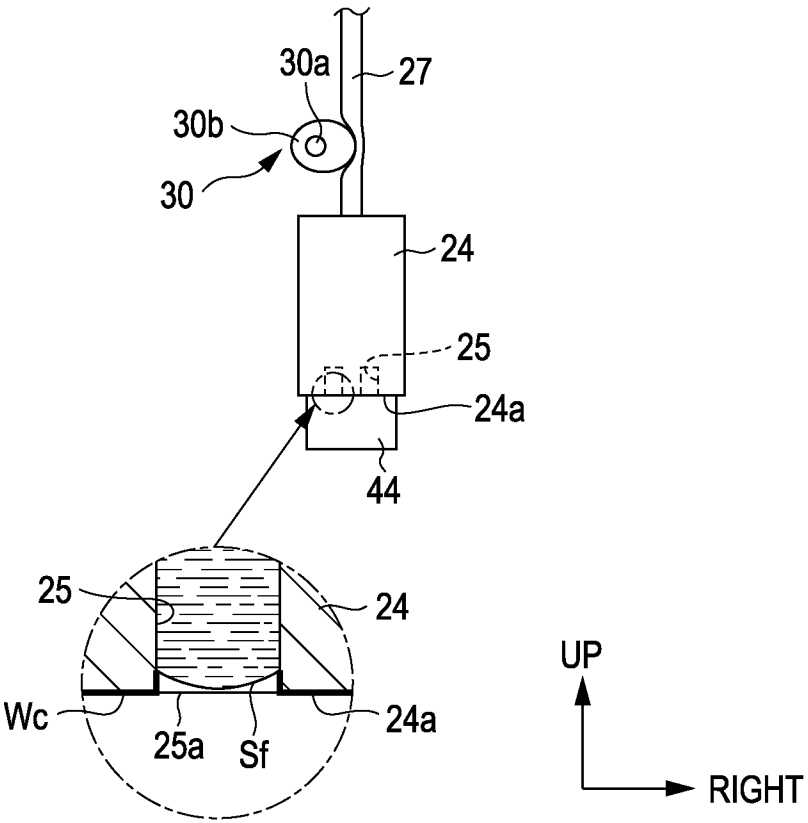
Figure 7A:
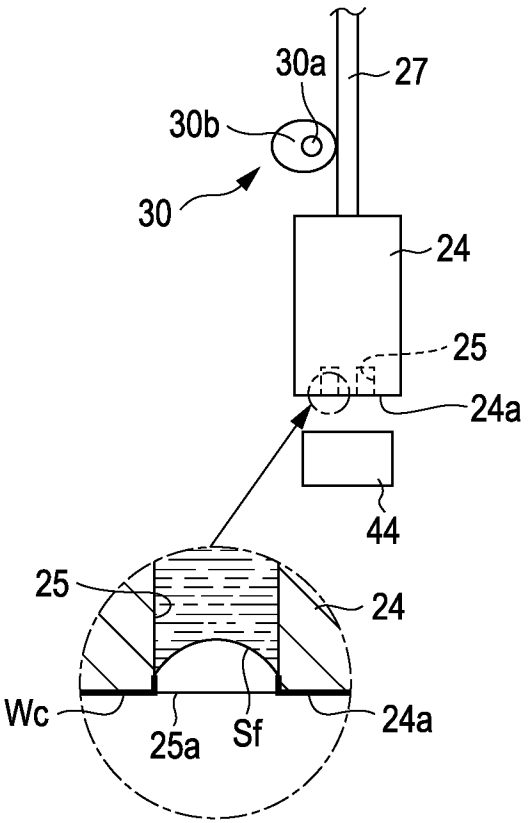

In the printer 11 of this embodiment, as shown in FIGS. 7A and 7B, a water repellent treatment is carried out at the nozzle formation face 24*a* of the fluid ejecting head 24 and in the vicinity of the nozzle orifice 25*a* of the nozzle 25. In addition, the portion marked by a thick line in FIGS. 7A and 7B, in which the water repellent treatment is carried out, is referred to as a water repellent treatment portion Wc. For this reason, the liquid surface Sf in the nozzle 25 retreats further inward than the water repellent treatment portion Wc, as shown in FIG. 7A, whereby the boundary of the liquid surface Sf is formed at an end portion (an upper end portion) of the water repellent treatment portion Wc.

For this reason, in this embodiment, even when the back pressure is set to be equal to or greater than the atmospheric pressure, so that a convex liquid surface Sf is formed, as shown in FIG. 7B, it is possible to apply pressure within a range in which the liquid surface Sf is not swollen from the nozzle orifice 25*a*.

According to the embodiment described above, in addition to the same working effects as the above (1), (2), and (4), the following effect can be obtained.

(5) Since the water repellent treatment is carried out in the vicinity of the nozzle orifice 25*a*, the liquid surface Sf retreats further to the inside of the nozzle 25 than the water repellent treatment portion Wc in which the water repellent treatment is carried out. Therefore, even if the back pressure is set to be equal to or greater than the atmospheric pressure, so that the convex liquid surface Sf is formed in the nozzle 25, it is possible to suppress excessive contact between the liquid surface Sf and the wiper 44 due to the protrusion of the liquid surface Sf from the nozzle orifice 25*a*. Also, by making the back pressure of the liquid Sf positive pressure in this manner, it is possible to further suppress the occurrence of dot omission.

In addition, the above-described embodiments may be changed to other embodiments as described below.

In the second embodiment, the curvature of the convex liquid surface Sf at the time of pressurization may be set to be larger than the curvature of the concave liquid surface Sf at the time of decompression.

An opening and closing valve, in which opening and closing can be controlled at an arbitrary timing, may be provided between the differential pressure valve 29 of the ink supply tube 27 and the pressurization mechanism 30. In this case, at the time of the suction cleaning or the pressurization cleaning, suction or pressurization is performed after the opening and closing valve is set to be in a valve closing state, and it is possible to improve air bubble discharging ability by increasing the flow velocity of ink by setting the opening and closing valve to be in a valve opening state while the pressure in the ink flow path is increased. Also, by setting the opening and closing valve to be in a valve closing state when performing pressurization by the pressurization mechanism 30, it is possible to prevent the pressurizing force from reaching the upstream side, thereby concentrating the pressurizing force on the downstream side.

The differential pressure valve 29 need not be provided. Even in this case, there are cases where a concave liquid surface is formed in the nozzle 25 in accordance with the type of fluid and the wettability of the nozzle 25. Also, by disposing the ink cartridge 26 (the cartridge holder (not shown)) at a position lower than the fluid ejecting head 24, it is also possible to make the inside of the fluid ejecting head 24 become a negative pressure due to a water head difference.

A pressurization mechanism provided with a piezoelectric element, a pump, a piston, or the like may be adopted. In this case, the fluid supply path can be constituted by a pipe line made of a rigid body that is not easily elastically deformed. As a result, it is possible to propagate a pressure fluctuation with pressurization to the inside of the fluid ejecting head 24 without absorbing it by elastic deformation of the pipe line.

In the case of supplying ink from one ink cartridge 26 to a plurality of fluid ejecting heads 24, the pressurization mechanism 30 may be provided at a single fluid supply path (the ink supply tube 27) that is connected to the ink cartridge 26, or the pressurization mechanism 30 may be provided for each fluid ejecting head 24.

The ink cartridge 26 may be a non-detachable ink tank.

The number of fluid ejecting heads 24 or nozzles 25 can be arbitrarily set.

The printer 11 may be realized as a line head printer of a full line type that is provided with an elongated fluid ejecting head, a lateral type printer, or a serial type printer.

In the embodiments described above, the fluid ejecting apparatus is embodied in an ink jet printer. However, a fluid ejecting apparatus that ejects or discharges fluid other than ink may be adopted or can be changed to various liquid ejecting apparatuses that are each provided with a liquid ejecting head or the like, that discharge a minutely small amount of liquid droplet. In addition, the liquid droplet describes a liquid in a state of being discharged from the liquid ejecting apparatus and also includes droplets of a granular shape, a tear shape, or droplets tailing into a line. Also, it is acceptable if the liquid as mentioned herein is a material that can be ejected by a liquid ejecting apparatus. For example, it is acceptable if the liquid is a substance in a liquid state, and the liquid includes not only liquids in a liquid state with high or low viscosity, a flow state such as sol, gel water, other inorganic or organic solvents, solution, liquid resin, or liquid metal (metal melt), and one state of substance, but also a material in which particles of a functional material composed of a solid material such as pigment or metal particles are dissolved, dispersed, or mixed in a solvent, or the like. Also, ink as described in the above-described embodiments, a liquid crystal, or the like can be given as representative examples of the liquid. Here, ink is set to include general water-based ink and oil-based ink and various liquid compositions such as gel ink, hot-melt ink, and the like. As more specific examples of the liquid ejecting apparatus, the following can be given: a liquid ejecting apparatus that ejects liquids that include, in a dispersed or dissolved form, materials such as an electrode material or a color material, which is used for the manufacturing or the like of, for example, a liquid crystal display, an EL (electroluminescence) display, a surface-emitting display, or a color filter; a liquid ejecting apparatus that ejects a biological organic matter that is used for the manufacturing of biochips; a liquid ejecting apparatus that is used as a precision pipette and ejects liquid that is a sample; a textile printing apparatus; a micro-dispenser; or the like. Further, the following liquid ejecting apparatuses may be adopted: a liquid ejecting apparatus that ejects lubricant oil to a precision machine such as a clock or a camera by using a pinpoint; a liquid ejecting apparatus that ejects a transparent resin solution such as ultraviolet curing resin onto a substrate in order to form a minute hemispherical lens (an optical lens) or the like which is used in an optical communication element or the like; and a liquid ejecting apparatus that ejects an etching solution such as acid or alkali in order to etch a substrate or the like. The invention can be applied to any one type of ejecting apparatus among these.

Further, the technical ideas that are understood from the above-described embodiments and each modified example will be described below.

(A) A fluid ejecting apparatus including:

a fluid ejecting head in which nozzles that eject fluid are provided;

a wiper that wipes a nozzle formation face, in which nozzle orifices of the nozzles are formed, in the fluid ejecting head;

a decompression mechanism that forms a concave liquid surface in the nozzle by performing decompression on the fluid in the fluid ejecting head in preparation for the ejection of the fluid; and a pressurization mechanism that changes the curvature of the liquid surface formed by the decompression, in the nozzle by performing pressurization on the fluid in the fluid ejecting head at the time of the wiping.

According to this configuration, since at the time of wiping, the pressurization mechanism performs pressurization on the fluid in the fluid ejecting head, when the wiper has drawn out fluid from the inside of the nozzle, the fluid is promptly supplied into the nozzle. As a result, the occurrence of dot omission can be suppressed. Also, a change of pressure by the pressurization mechanism is performed within a minute range of an extent that changes the curvature of the liquid surface in the nozzle without moving the position of the boundary of the liquid surface. For this reason, since the contact between the wiper and the liquid surface is only for a short time while the wiper enters into and passes through the nozzle, continuous outflow of the fluid is avoided. Therefore, it is possible to suppress the occurrence of dot omission while also suppressing the consumption of the fluid involved in wiping.

(B) A wiping method that wipes a nozzle formation face in which the nozzle orifices of nozzles in a fluid ejecting head, in which the nozzles that eject fluid are provided, are formed, wherein the fluid in the fluid ejecting head is decompressed in preparation for the ejection of the fluid, and a state where a concave liquid surface is formed in the nozzle becomes a steady state, the method including: a wiping process that wipes the nozzle formation face in a state where curvature of the liquid surface formed by the decompression is changed in the nozzle by pressurizing the fluid in the fluid ejecting head which is in the steady state.

According to this configuration, since at the time of wiping, the fluid in the fluid ejecting head is pressurized, in a case where the wiper has drawn out fluid from the inside of the nozzle, the fluid is promptly supplied into the nozzle. As a result, the occurrence of dot omission can be suppressed. Also, a change of pressure by pressurization is performed within a minute range of an extent that changes the curvature of the liquid surface in the nozzle without moving the position of the boundary of the liquid surface that comes into contact with the nozzle. For this reason, since the contact between the wiper and the liquid surface is only for a short time while the wiper enters into and passes through the nozzle, continuous outflow of fluid is avoided. Therefore, it is possible to suppress the occurrence of dot omission while suppressing the consumption of the fluid involved in wiping.

(C) A maintenance unit that is used in a fluid ejecting apparatus having a fluid ejecting head in which the nozzles that eject fluid are provided, the unit including:

a wiper that wipes a nozzle formation face, in which nozzle orifices of the nozzles are formed, in the fluid ejecting head; and a pressurization mechanism that changes the curvature of a concave liquid surface formed in the nozzle, in the nozzle by performing pressurization on the fluid in the fluid ejecting head at the time of the wiping.

According to this configuration, since at the time of wiping, the pressurization mechanism performs pressurization on the fluid in the fluid ejecting head, in a case where the wiper has drawn out the fluid from the inside of the nozzle, the fluid is promptly supplied into the nozzle. As a result, the occurrence of dot omission can be suppressed. Also, a change of pressure by the pressurization mechanism is performed within a minute range of an extent that changes the curvature of the liquid surface in the nozzle without moving the position of the boundary of the liquid surface. For this reason, since the contact between the wiper and the liquid surface is only for a short time while the wiper enters into and passes through the nozzle, continuous outflow of fluid is avoided. Therefore, it is possible to suppress the occurrence of dot omission while suppressing the consumption of the fluid involved in wiping.

The entire disclosure of Japanese Patent Application No. 2010-028100, filed Feb. 10, 2010 is expressly incorporated by reference herein.

What is claimed is:

1. A fluid ejecting apparatus comprising:

a fluid ejecting head in which nozzles that eject fluid are provided;

a wiper which wipes a nozzle formation face, in which nozzle orifices of the nozzles are formed, in the fluid ejecting head; and a pressurization mechanism which changes the curvature of a concave liquid surface formed in the nozzle by performing pressurization on the fluid in the fluid ejecting head at the time of the wiping.

2. The fluid ejecting apparatus according to claim 1, wherein the pressurization mechanism performs the pressurization in such a manner that a position of a boundary of the liquid surface is fixed during pressurization and also a central area of the liquid surface is not swollen from the nozzle orifice.

3. The fluid ejecting apparatus according to claim 2, wherein a water repellent treatment is carried out in the vicinity of the nozzle orifice of the nozzle, and the pressurization mechanism performs the pressurization such that pressure of the fluid in the fluid ejecting head, the pressure serving as a back pressure of the liquid, becomes equal to or greater than pressure of gas which comes into contact with the liquid surface.

4. The fluid ejecting apparatus according to claim 2, wherein the concave liquid surface is formed in the nozzle such that the boundary of the liquid surface comes into contact with the nozzle orifice and also the central area of the liquid surface is drawn into the nozzle.

5. The fluid ejecting apparatus according to claim 1, further comprising:

a decompression mechanism which performs decompression on the fluid in the fluid ejecting head, wherein the pressurization mechanism performs the pressurization such that the curvature of the liquid surface becomes smaller than that at the time of the decompression.

6. A wiping method which wipes a nozzle formation face in which nozzle orifices of nozzles are formed, the nozzles being provided in a fluid ejecting head and ejecting fluid, the method comprising:

wiping the nozzle formation face in a state where curvature of a concave liquid surface formed in the nozzle is changed in the nozzle by pressurizing the fluid in the fluid ejecting head.

* * * * *